United States Patent [19]

Zwart

[11] Patent Number: 4,607,692

[45] Date of Patent: Aug. 26, 1986

[54] WIRELINE JAR

[76] Inventor: Klaas Zwart, Unit 4, Harlaw Centre, Howe Moss Crescent, Kirkhill Industrial Estate, Dyce, Aberdeen, Scotland

[21] Appl. No.: 683,810

[22] Filed: Dec. 20, 1984

[30] Foreign Application Priority Data

Dec. 21, 1983 [GB] United Kingdom ..... 8333957

[51] Int. Cl.[4] ..... E21B 4/06; E21B 31/107

[52] U.S. Cl. ..... 166/178; 175/299; 175/300

[58] Field of Search ..... 175/299, 300, 302, 303, 175/304; 166/178; 294/86.23

[56] References Cited

U.S. PATENT DOCUMENTS

| | | | |
|---|---|---|---|
| 2,621,025 | 12/1952 | Denning | 175/304 |
| 2,671,640 | 3/1954 | Baker | 166/178 |
| 3,203,482 | 8/1965 | Lyles | 175/299 |
| 4,130,169 | 12/1978 | Denison | 175/299 |
| 4,142,597 | 3/1979 | Johnston | 175/304 |
| 4,333,542 | 6/1982 | Taylor | 175/299 |
| 4,494,615 | 1/1985 | Jones | 175/299 |

FOREIGN PATENT DOCUMENTS

| | | | |
|---|---|---|---|
| 354113 | 10/1972 | U.S.S.R. | 175/299 |

*Primary Examiner*—James A. Leppink
*Assistant Examiner*—Hoang C. Dang
*Attorney, Agent, or Firm*—Harry M. Weiss & Associates

[57] ABSTRACT

An upstroke wireline jar having a hammer 12 at the bottom end of an operating rod 3 which is axially slidable in a casing 2 having an anvil 13 at its upper end. This casing also includes a releasable coupling means which is biased downwards by a spring 5 to a rest position, said coupling means comprising a sleeve 4 which receives the rod 3 into its upper end and a plurality of arcuate segments 9 which are contained in apertures in the sleeve and engage in a circumferential groove 10 in the rod. Circumferential recesses 11 and 17 in the interior wall of the casing 2 are adapted to partially receive the segments when the sleeve is in appropriate registration therewith thereby facilitating disconnection and subsequent re-engagement of the operating rod with the sleeve. The spring 5 is mounted below the hammer so as to allow free travel of the latter along a substantial portion of the casing. The spring is provided with an upper abutment 6 mounted on a rod 7 the axial position of which is adjustable from outside the jar. At its bottom end the spring 5 abuts a flanged bush 15 which depends from the sleeve 4. A second spring 6 assists in biasing the sleeve to its rest position.

13 Claims, 6 Drawing Figures

WIRELINE JAR

BACKGROUND OF THE INVENTION

This invention relates to an upstroke mechanically operated wireline jar for use in the downhole environment of an oil well.

A wireline run in an oil well can perform downhole operations under high pressures and at substantial depths. Pressures of 10,000 psi ($6.85\times10^7$ N/m$^2$) and depths of 15,000 ft (4.572 km) are not uncommon. Solid wirelines known as slicklines, of small diameter and smooth finish, seal and run through stuffing boxes. Commonly found wire thicknesses are 0.092 in. (2.34 mm) and 0.108 in. (2.74 mm) diameter. The wireline is wound onto a winch on the surface. The wireline thickness is as small as possible to minimise the piston effect of the high well pressure below over the atmospheric pressure above, acting on the cross-sectional area of the wireline. The piston effect is kept under control by sinker bars, or weights, at the end of the wire. The wireline diameter is also desirably small to minimise metal fatigue of the wire in use, and for flexibility.

Minimising the wireline diameter has the disadvantage that the force which can be applied to the wireline is limited. To achieve a large force which may be required downhole, a tool known as a jar is used which creates such a force by the impact of one member hammering on another. A simple form of jar, known as a link jar, is operated by pulling the sinker bar up or dropping it down very quickly. This necessitates high speed rotation of the winch, with the possibility of wire fatigue and breakage.

To overcome this problem, prior art jars have been used which comprise an operating rod carrying a hammer and biased against the wireline pull by a spring. After a predetermined tension is achieved, a tripping mechanism operates to release the rod from the action of the spring whereupon the rod flies upwards until the hammer strikes an anvil on the jar casing. In one such device the tripping mechanism and spring are carried on the rod at its bottom end and are subject to damage during the jar stroke. In another such device the spring is situated at the top of the casing and the rod passes through it, the spring force being transmitted to the bottom end of the rod via a prong or yoke arranged around the rod. Such an arrangement limits the length of stroke available for the operating rod. This latter device provides for the adjustment of the spring tension after the removal of a cap at the top of the tool.

SUMMARY OF INVENTION

According to the present invention an upstroke mechanically operated wireline jar comprises a casing having an internal downwardly facing shoulder defining an anvil, a rod which is slidable axially in said casing the upper end of said rod projecting from the casing and having means for connecting the jar to a wireline, said rod bearing hammer means, in said casing, which is adapted to strike the said anvil means on an upward stroke of the rod, resilient biasing means acting between said rod and said casing so as to resist initial upward displacement of said rod from a rest position defined by the resilient biasing means, said displacement being caused as a consequence of tension in said wireline, and tripping means comprising an intermediate coupling member between said rod and said biasing means for abruptly disconnecting said biasing means from said rod upon a predetermined upward displacement of the rod whereby upon said disconnection said force on said rod accelerates its upward movement, causing the hammer means to impact the anvil means, resetting of the jar being carried out by means of a downward force applied by the rod on said intermediate coupling member against an upwardly biasing member, characterised in that said resilient biasing means comprises spring means situated in said casing below the rod, said spring means abbutting a fixed abutment at its upper end and being coupled at its lower end to said intermediate coupling member so as to exert a downward bias force on said coupling member when the latter is upwardly displaced by displacing the rod from said rest position.

The invention provides for a simplified design of an upstroke wireline jar in which the biasing means, such as a spring, will not interfere with the stroke of the operating rod. Thus the jar mechanism will be less subject to damage during operation, and the length of stroke of the rod is not unnecessarily limited.

To enable re-cocking of the jar for a repeated operation, the tripping means preferably includes a bush telescopically disposed within a sleeve, such that said bias force acts through said bush to said sleeve, and such that said sleeve is capable of downward movement independently of said bush to allow engagement of said sleeve with the operating rod by the tripping means.

According to another aspect of the invention, there is provided an upstroke wireline jar comprising an operating rod carrying a hammer member and axially, reciprocally, movably mounted within a casing formed with an anvil member, such that axial movement of the rod in an upward direction to the full extent thereof will cause the hammer member to strike the anvil member and create a jarring action, wherein said biasing means are provided acting at a point fixed relative to the casing and located such that the hammer means moves away therefrom during said axial movement of the rod, said biasing means opposing said axial movement for a predetermined amount thereof upon which a tripping mechanism operates to free the rod from the action of the biasing means, whereby force applied to the rod to cause said predetermined amount of axial movement will be effective to move the rod to said full extent thereof to create said jarring action.

The novel features which are believed to be characteristic of the invention together with further objects and advantages will be better understood from the following description when considered in connection with the accompanying drawings of a preferred embodiment of the invention which are provided by way of example.

DESCRIPTION OF THE PREFERRED EMBODIMENT

Figure 1A:
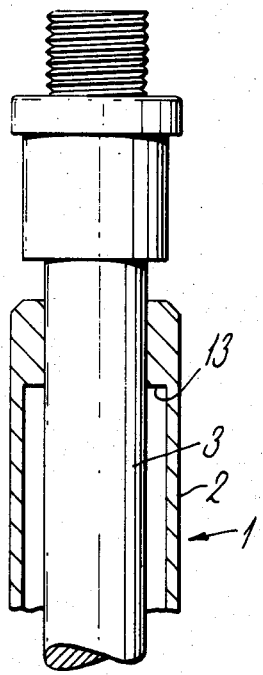
FIGS. 1A and 1B show, in partial section, respectively the upper and lower part of an embodiment of an upstroke mechanically operated wireline jar in accordance with the invention when in the cocked condition.
Figure 1B:
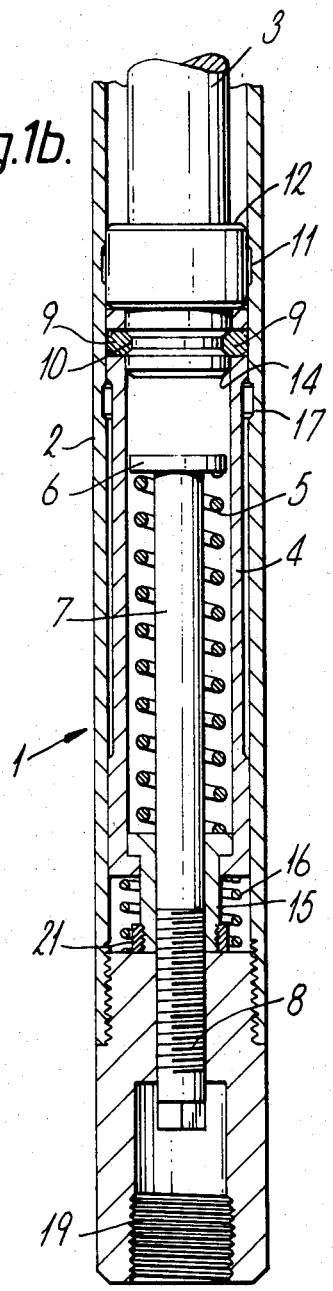

In FIG. 1, an upstroke, mechanically operated wireline jar 1 comprises a casing 2 carrying an operating rod 3 releasably linked to a sleeve 4. The sleeve 4 is biased downwards by means of spring 5 bearing on a shoulder 6 provided on a rod 7 at its top end. The rod 7 is held fixed relative to the casing 2 by a screw-threaded portion 8 mounted in the bottom of the casing 2.

The releasable link between the operating rod 3 and the sleeve 4 is provided by a plurality of arcuate segments carried in apertures in the sleeve 4 and engaging in a circumferential groove 10 formed at the trailing or lower end of the operating rod 3. A shoulder 12 on an enlarged portion of the operating rod 3 comprises a hammer which impacts a complementary shoulder 13 provided by the casing at its top end.

Figure 2A:
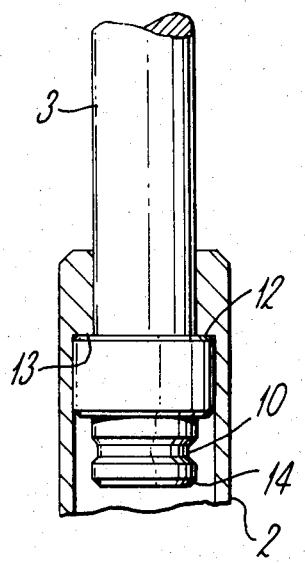
FIGS. 2A and 2B show the jar of FIG. 1 after tripping.
Figure 2B:
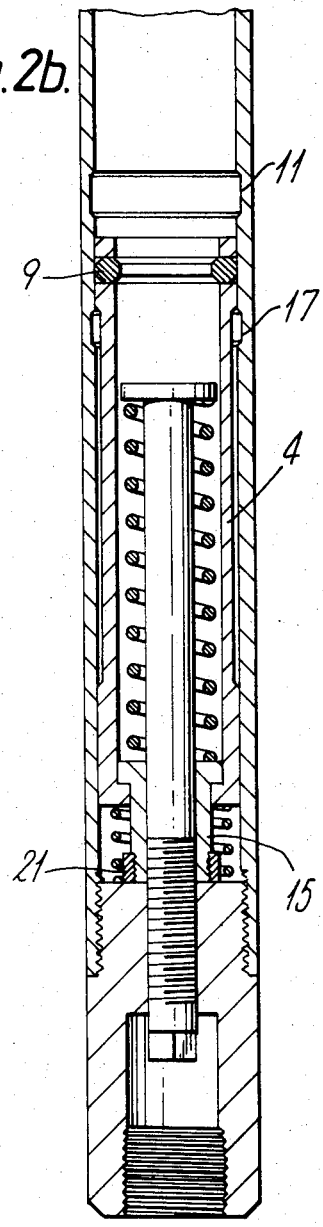

To operate the jar, the operating rod 3 is pulled up from above by a wireline in which a tension is produced. The force applied must be sufficient to overcome an initial downward bias on the sleeve 4 by the spring 5, whereupon the rod 3 and sleeve 4 move upwardly together until the segments 9 align with a circumferential recess 11 formed in the casing wall. The segments then move outwardly into the recess 11, under the action of a chamfered surface of the lower edge of the groove 10 and a complementary chamfer on the engaging edges of the segments. This frees the locking of the rod 3 to the sleeve 4. The force applied to the rod 3 by the wireline will cause it to move rapidly upwards, quickly gaining momentum, until the shoulder 12 of the hammer portion at the end of the control rod 3 hits the shoulder 13 provided at the upper end of the casing 2 to create the required jarring action (FIG. 2). The sleeve 4 returns to its starting position under the action of the spring 5 and a further spring 16 which acts on the underside of the sleeve, the segments 9 being pushed inwards by the chamfered edges of the recess 11 and the segments at the start of this return movement.

To reset the jar, the operating rod 3 is pushed down initially until a chamfer 14 at the bottom end of the rod 3 contacts the segments 9. The sleeve 4, upon which the spring 5 acts indirectly through a bush 15, is free to move downwardly relative to the bush 15 against the action of the second spring 16. Continued downward movement of the operating rod 3 pushes the sleeve 4 down until the segments 9 align with a second circumferential recess 17 formed in the casing wall. The segments 9 are moved outwardly into the recess 17 by the action of the chamfer 14 on the end of the rod 3. The sleeve 4 is thus locked relative to the casing 2, while the rod 3 continues its downward movement until the groove 10 spaced from the bottom end of the rod 3 aligns with segments 9, whereupon the sleeve 4 moves upwardly under the action of the second spring 16 and complementary chamfers provided on the segments and the groove 17, causing the segments to move inwardly to engage the groove 10 and thus lock the rod 3 to the sleeve 4. The jar is now in a cocked condition, ready for a further operation.

Figure 3:
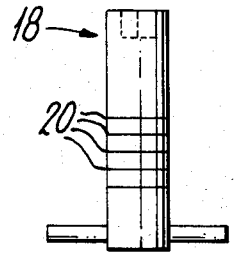
FIG. 3 shows a key for adjusting the spring tension of the jar of FIG. 1.

The preset tension of spring 5 is adjustable to accommodate different wire thicknesses and sinker bar weights, by means of an adjustment key 18 shown in FIG. 3. The key 18 is inserted into a hole 19 at the lower end of the housing 2, and engages the rod 7 which is raised or lowered through its screw-threaded portion 8 to provide the desired spring tension. Indicator markers or grooves 20 on the key 18 allow the tension to be gauged.

The bush 15 is also externally threaded at its lower end and has a stop ring 21 mounted thereon. Stop ring 21 limits the downward movement of the sleeve 4, thereby preventing the spring 16 from being damaged by an overtravel of the sleeve during the resetting operation.

Figure 4:
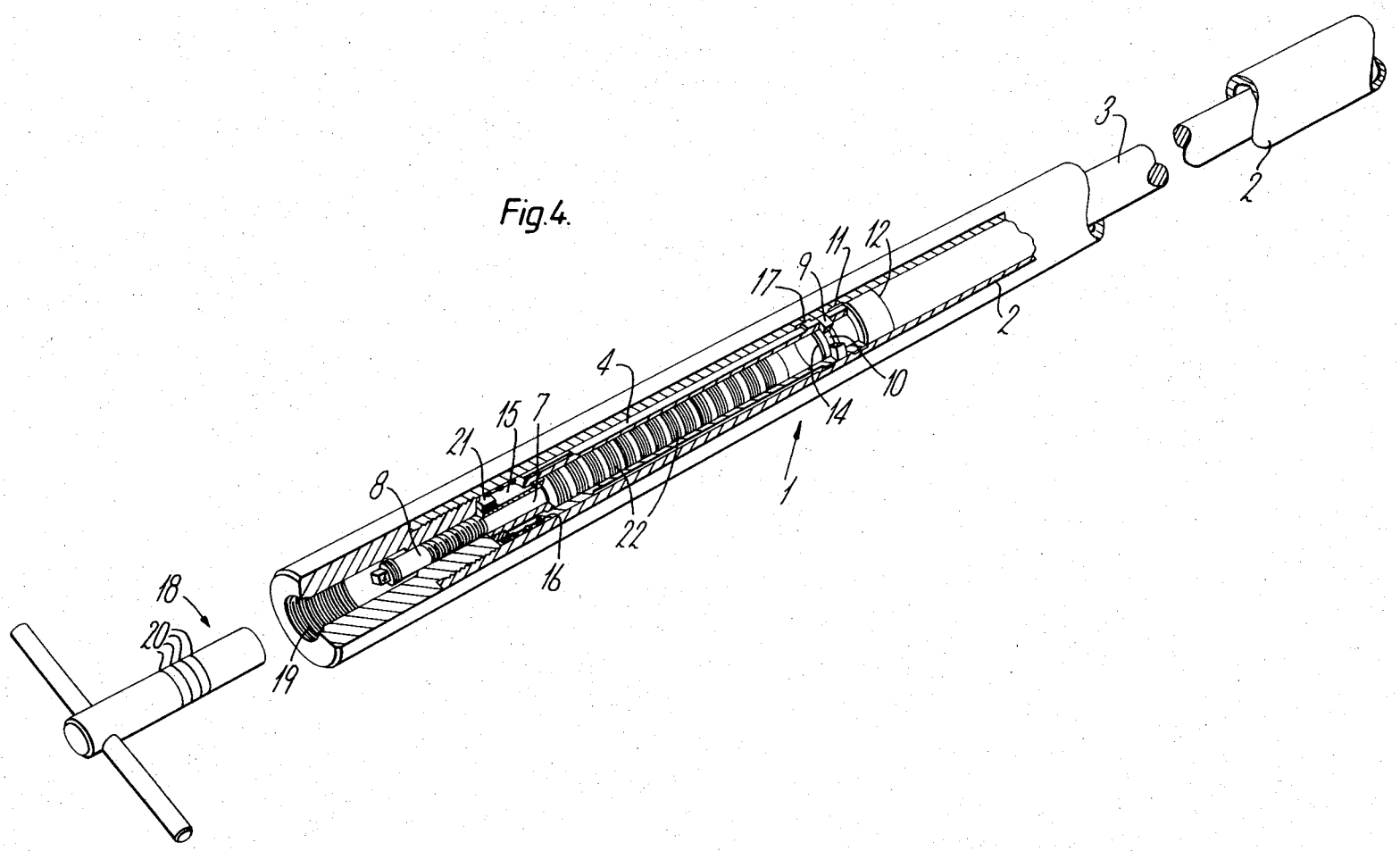
FIG. 4 is a cut-away perspective view of a further embodiment of the invention.

FIG. 4 shows a second embodiment of the invention wherein the helical spring 5 is replaced by a set of disc springs 22. These are arranged in pairs with successive pairs facing alternate directions. Disc springs provide for an improved performance having regard to the dimensional limitations of the device.

The other parts of this embodiment are similar to the corresponding parts of the embodiment shown in FIGS. 1A, 1B, 2A and 2B, and carry the same reference numbers.

Various other alternative arrangements within the ambit of the invention will be apparent to a skilled worker. For example, the spring 5 can be positioned on the outside of the sleeve 4 and bear at its lower end on an external flange or abutment ring on the bush 15. The axial position of this flange or abutment ring can be made adjustable by providing a screw-threaded mounting in the bush for the flange or abutment ring. A fixed downward-facing abutment on the casing 2 must be provided for the upper end of the spring, in place of the previous rod 7. To make room for the spring 5 it is convenient to shorten the sleeve 4 and lengthen the bush 15 so that, in effect, the spring is positioned beneath the sleeve rather than outside it. It is also convenient with this arrangement to provide an upward-facing abutment on the casing above the top end of spring 5 to receive the bottom end of spring 6.

All such alternative arrangements are considered to be within the scope of the invention as defined by the appendant claims.

What is claimed is:

1. In an upstroke mechanically operated wireline jar for downhole operations in oil wells and similar installations comprising a hollow casing having an internal downwardly facing shoulder defining anvil means, a first rod which is slidable axially in said casing the upper end of said rod projecting from the casing and having means for connecting the jar to a wireline, said rod bearing hammer means, in said casing, which is adapted to strike the said anvil means on an upward stoke of the rod, first resilient biasing means within said casing acting between said rod and said casing so as to resist initial upward displacement of said rod from a rest position defined by the said first resilient biasing means, said displacement being caused as a consequence of tension in the wireline, and an intermediate coupling member within said casing connecting said first rod and said biasing means and including tripping means for abruptly disconnecting said biasing means from said rod upon a predetermined upward displacement of the rod, whereby upon said disconnection the force on said rod caused by the tension in the wireline accelerates its upward movement causing the hammer means to impact the anvil means, resetting of the jar being carried out by means of a downward face applied by the rod on said intermediate coupling member against an upwardly biasing means, the improvement comprising a sleeve which is slidingly supported in said casing, said sleeve being adapted to receive the end of the said first rod in its upper end, said sleeve further defining through-wall apertures in its upper end and an internal shoulder at its lower end and said jar comprising a second upstanding coaxially disposed rod within said casing, said second rod having an upper first end within said sleeve defining a shoulder below and adjacent to said first rod and a second lower end fixedly mounted on said casing, said first resilient biasing means being supported coaxially on said second rod between the internal shoulder of the sleeve and the shoulder on said second rod, said through-wall apertures containing coupling means, said coupling means simultaneously physically engaging the internal walls of the casing and a respective bevelled circumferential groove in the first rod, the internal wall of said casing furthermore defining at least two axially spaced apart circumferential bevelled slots disposed along the path of displacement of the sleeve, so that on upward displacement of the first rod in the preset condition of the jar through said predetermined displacement, the sleeve is likewise displaced until the coupling means enters the uppermost slot in the casing and releases the first rod from the said sleeve, the latter being then returned by said first resilient biasing means to its initial location, corresponding to the unstressed condition of the wireline, and when the first rod is displaced downwards, after tripping, by means of a downward movement of the wireline, the first rod enters the sleeve, engages the coupling means, and drives the sleeve downwards until said coupling means enters the lower said slot in the internal wall of the casing, so as to temporarily secure the sleeve to the casing whilst further downward movement of the first rod occurs, thereby permitting re-entry of the coupling means in the groove of the first rod and re-engagement of the latter with the said sleeve.

2. A wireline jar according to claim 1 wherein the coupling means comprise a plurality of arcuate segments, each of said segments having bevelled concave and convex edges.

3. A wireline jar according to claim 1 wherein said bush abuts the bottom end of the casing when the jar is in its preset, rest condition.

4. A wireline jar according to claim 1 wherein said bush has a threaded stop ring fitted at its bottom end which limits the downward displacement of the sleeve.

5. A wireline jar according to claim 1 wherein said second rod is screw-threadedly mounted in the bottom of the said casing such that the bottom end of the second rod is accessible from outside the jar, and wherein the said end of the second rod is configured to receive a key by means of rotation of which the rod may be raised or lowered in said casing.

6. A wireline jar according to claim 1 wherein said sleeve includes a slidable bush, depending from and below its lower end forming the lower abutment of said first resilient means, said second rod being slidable within said bush, and wherein a second resilient means is mounted on said second rod and is situated between the casing and the lower end of the sleeve so as to arrest movement of the sleeve after it has released from the first rod during operation of the jar and which returns the sleeve to a position in which said coupling means is situated in between said upper and said lower slot.

7. A wireline jar according to claim 6 wherein said second rod is mounted in a removable plug which forms the bottom closure of the casing, and the latter consists of a two-piece construction comprising a cylindrical member and said plug.

8. A wireline jar according to claim 1 wherein said second rod is mounted in a removable plug which forms the bottom closure of the casing and the latter consists of a two-piece construction comprising a cylindrical member and said plug.

9. An upstroke wireline jar comprising a casing and a first operating rod carrying hammer means, said casing being formed with an internal anvil means and said first rod extending into the upper end of the casing and being axially slidable therein such that upward movement of the rod to its full extension causes the hammer means to impact the anvil means, a sleeve slidable within said casing, first resilient biasing means acting on the sleeve to resist upward movement thereof from a rest position, said sleeve being adapted to engage the lower end of said first rod and having an annular wall portion defining at least one through-wall aperture, there being engaging means in said at least one aperture adapted to engagement interior wall of the casing and simultaneously to engage a circumferential slot in the bottom end portion of said rod, there being first and second axially spaced apart recesses in said interior wall of said casing, said first recess being adapted to receive said engaging means upon a first prescribed, upward displacement of said sleeve from the rest position caused by an upward displacement of the rod thereby releasing said sleeve from said rod, said second recess being adapted to receive said engaging means upon a second prescribed downward displacement of said sleeve from said rest position caused by a downward displacement of the rod when the latter is disengaged from said sleeve, said rod thereby reengaging the sleeve and said engaging means, said jar further comprising a second resilient biasing means acting on the bottom end of said sleeve so as to resist said downward displacement, a second upstanding rod fixedly mounted in the bottom end of the casing, said rod entering said sleeve and having a flange portion at its upper end which comprises an upper abutment for the first resilient biasing means, said sleeve further having a bush and an internal flange at its lower end, said bush freely depending from said internal flange of the sleeve being slidable therein and slidably receiving said second rod, said bush comprising a lower abutment of the first said resilient biasing means, said second resilient biasing means being coaxially disposed outside said bush between the lower end of said sleeve and said casing and positioning said casing at its rest position so that the said engaging means is positioned mid-way between said recesses in the interior wall of the casing.

10. An upstroke wireline jar according to claim 9 wherein the bottom end of said bush abuts a bottom wall of the casing when the sleeve is at the said rest position, there being a stop ring mounted on said bush at its bottom end for limiting the downward displacement of said sleeve.

11. An upstroke wireline jar according to claim 9 wherein said second rod is screw threaded at its bottom end and is mounted in a corresponding screw thread in said casing at its bottom end, said casing being adapted to expose the end of the second rod and said end of the second rod being adapted to receive means for rotating it about its axis.

12. An upstroke wireline jar according to claim 9 wherein said engaging means comprise a plurality of arcuate segments, each of said segments having bevelled concave and convex edges, each said segment being housed in a respective one of a corresponding plurality of said through-wall apertures on said sleeve.

13. A wireline jar according to claim 9 wherein said second rod is mounted in a removable plug which forms the bottom closure of the casing, and the latter consists of a two-piece construction comprising a cylindrical member and said plug.

* * * * *